US005356028A

United States Patent [19]

Heuberger et al.

[11] Patent Number: 5,356,028

[45] Date of Patent: Oct. 18, 1994

[54] FOLDING BOX WITH INNER BAG AND PROCESS FOR MANUFACTURING SAME

[75] Inventors: Erich Heuberger, Trugenhofen; Wolf-Dieter Knörrich, Heidenheim, both of Fed. Rep. of Germany

[73] Assignee: Carl Edelmann GmbH, Heidenheim, Fed. Rep. of Germany

[21] Appl. No.: 937,859

[22] PCT Filed: Feb. 14, 1992

[86] PCT No.: PCT/DE92/00116

§ 371 Date: Feb. 9, 1993

§ 102(e) Date: Feb. 9, 1993

[87] PCT Pub. No.: WO92/14652

PCT Pub. Date: Sep. 3, 1992

[30] Foreign Application Priority Data

Feb. 14, 1991 [DE] Fed. Rep. of Germany ..... 4104559

[51] Int. Cl.[5] ..... B65D 5/56

[52] U.S. Cl. ..... 220/462; 220/416; 220/418; 493/60; 493/62; 493/96

[58] Field of Search ..... 220/416, 418, 461, 462; 493/59–62, 96, 97; 229/930

[56] References Cited

U.S. PATENT DOCUMENTS

| | | | |
|---|---|---|---|
| Re. 20,789 | 7/1938 | Bergstein | 493/97 |
| 1,705,748 | 3/1929 | Bridgman | 229/930 |
| 2,493,337 | 1/1950 | Buttery | 220/416 |
| 2,589,022 | 3/1952 | Page, Jr. et al. | 493/62 |
| 2,710,134 | 6/1955 | Schroeder et al. | 220/418 |
| 2,799,211 | 7/1957 | Zerlin et al. | 493/97 |
| 2,950,036 | 8/1960 | Vergobbi | 220/418 |
| 3,038,889 | 4/1963 | Christensson | 220/418 |
| 3,182,883 | 5/1965 | Doble, Jr. | 220/418 |
| 3,459,357 | 8/1969 | Egger et al. | 493/96 |
| 3,550,833 | 12/1970 | Rahenkamp | 220/418 |
| 3,878,771 | 4/1975 | Malcolm | 493/97 |
| 3,907,193 | 9/1975 | Heller | 229/930 |
| 4,478,351 | 10/1984 | Homma | 220/462 |

*Primary Examiner*—Gary E. Elkins

*Attorney, Agent, or Firm*—Brooks Haidt Haffner & Delahunty

[57] ABSTRACT

A pre-glued, flat folding box contains a section of tubular film (5) glued to the box to form an inner bag. The tubular film section has bending lines (8,9) in all four corners of the body of the folding box which extend to the edges of the section of tubular film. This makes it easier to erect the folding box containing the section of tubular film and to fill and close the package.

8 Claims, 1 Drawing Sheet

FOLDING BOX WITH INNER BAG AND PROCESS FOR MANUFACTURING SAME

BACKGROUND OF THE INVENTION

The invention relates to a pre-glued, flat folding box, consisting of a body portion comprising flaps connected to the open sides of the body portion and a tubular foil section having open ends and arranged in the body portion which, when erected, has a cross section corresponding to the inner cross section of the body portion. Folding boxes of this kind are generally known.

These folding boxes are used for packaging pourable products, especially liquids. They are delivered to the filler of the pourable product in flat condition for saving space. At the filler, these folding boxes are erected in a filling and packaging machine, are sealed and closed first at one end, filled with the product and then sealed and closed at the other end.

Experience has shown that the erection of the folding box has caused certain difficulties in the packaging machine. These difficulties result from the fact that the tubular foil is very flat in the flat folding box, so that its walls contact each other and a certain lip effect develops at its edges during erection, since no air can flow into the interior of the tubular foil section due to the close contact of the tubular foil walls. On the contrary, the vacuum generated during the erection of the folding box in the interior of the tubular foil section even increases this lip effect. After erection it can be seen that at the open cross section of the tubular foil section only two opposite corners are present in a more distinct form, i.e. the corners at which the tubular foil section was located in folded form in the flat folding box. This insufficient formation of the desired rectangular form of the cross section opening of the tubular foil section causes difficulties in filling the erected folding box as well as in sealing the tubular foil section.

It is the object of the invention to provide a folding box of the above mentioned kind, which is easier to erect, to fill and to seal.

SUMMARY OF THE INVENTION

In contrast to the prior art, in the invention the tubular foil section in the folding box comprises continuously embossed fold lines extending up to the edge of the tubular foil section at all locations which are in the corners of the body cross section, said fold lines providing the tubular foil section in erected not closed condition of the folding box with a basically rectangular cross section.

Combined with a certain spring force of the tubular foil material, the fold lines, which are located in the pre-glued, flat folding box in the fold lines, which join contiguously lying walls of the folding box body, have the effect, that the above mentioned lip effect is basically avoided. An insulating air cushion is generated between the walls lying on one another in the non-erected condition of the folding box, especially in the area between the flaps, said insulating air cushion preventing the edges of the tubular foil section from lying on one another completely tight. Because of the air cushion, the edges of the foil sections do not stick together and completely seal the interior of the tubular foil section to the outside due to the vacuum occuring in the interior during erection of the folding box.

In the erected condition of the folding box, the tubular foil section offers a better rectangular form of the opening cross section in the area between the flaps with which it is not connected to, which facilitates not only the filling process but also the following sealing process of the tubular foil section, e.g. by means of welding.

The invention is especially suitable in combination with tubular foil materials, which have a certain spring force which is the case e.g. in certain plastic foils.

Compound foils made of paper and plastic, of paper, aluminium and polyethylene, of aluminium and plastic or of different kinds of plastic are suitable as tubular foil material. So-called mono-foils which are especially desriable due to waste disposal reasons can be used, as well as polyester foils.

The sealing of such foils is done by the aid of heat, ultrasonics or high frequency, depending on the selected kind of material.

The material of the folding box could be cardboard, corrugated board and other common folding box materials.

For the manufacture of such a folding box blank a foil web made of a sealable material from a roil is generally used. This foil web is not only formed to a tube, as is generally known from the prior art, by folding and sealing, especially by welding the two edges, but four folds extending in longitudinal lines are provided. These folds are especially embossed into these foil webs which are distributed across the width of the foil web, said folds having the effect in case of suitable selection of material, that the foil after folding and welding is not completely flat anymore. Insulating air cushions result at least in partial sections of the cross section within the tubular foil or within the tubular foil section separated from the tubular foil. The partial sections being open to the outside thus enable the inflow of air during erection of the box.

Such a tubular foil section is put on a prepared, flat open cardboard blank, so that two of the surfaces of the tubular foil section separated from one another by a fold line lie on the matching two sections of the body portion of the folding box blank. The tubular foil section is glued on said two sections of the body portion of the folding box blank. Afterwards the portion of the folding box blank not covered by the tubular foil section is folded over the tubular foil section and glued thereto in the area of the two other body sections of the folding box blank. Additionally, the folding box blank is glued together by means of a flap which is formed at the folding box blank, so that a pre-glued flat folding box is formed which can be formed to a right parallelpiped cuboid-like tube body of rectangular cross section during erection. It is clear that the longitudinally extending welding seam which is produced during the manufacture of the tube from the foil, extends in such a section of the tubular foil section located in the folding box, where it does not prevent the following sealing of the tubular foil section to form a closed bag. This welding seam preferably extends in one of the two main surfaces of the folding box.

The fold lines can be formed in the foil web by the aid of conventional folding devices over which the foil web is drawn, or also by the aid of embossing rollers, which are provided with circumferential grooves and matching embossing rollers, which project into the circumferential grooves and together form a small gap between which the material of the foil web is passed through. Combinations of both methods are also possible. The effect of heat for example can improve the formation and the constancy of the fold lines.

The invention will now be described with reference to an embodiment of a folding box in the drawings:

DETAILED DESCRIPTION PREFERRED EMBODIMENT

Figure 1:
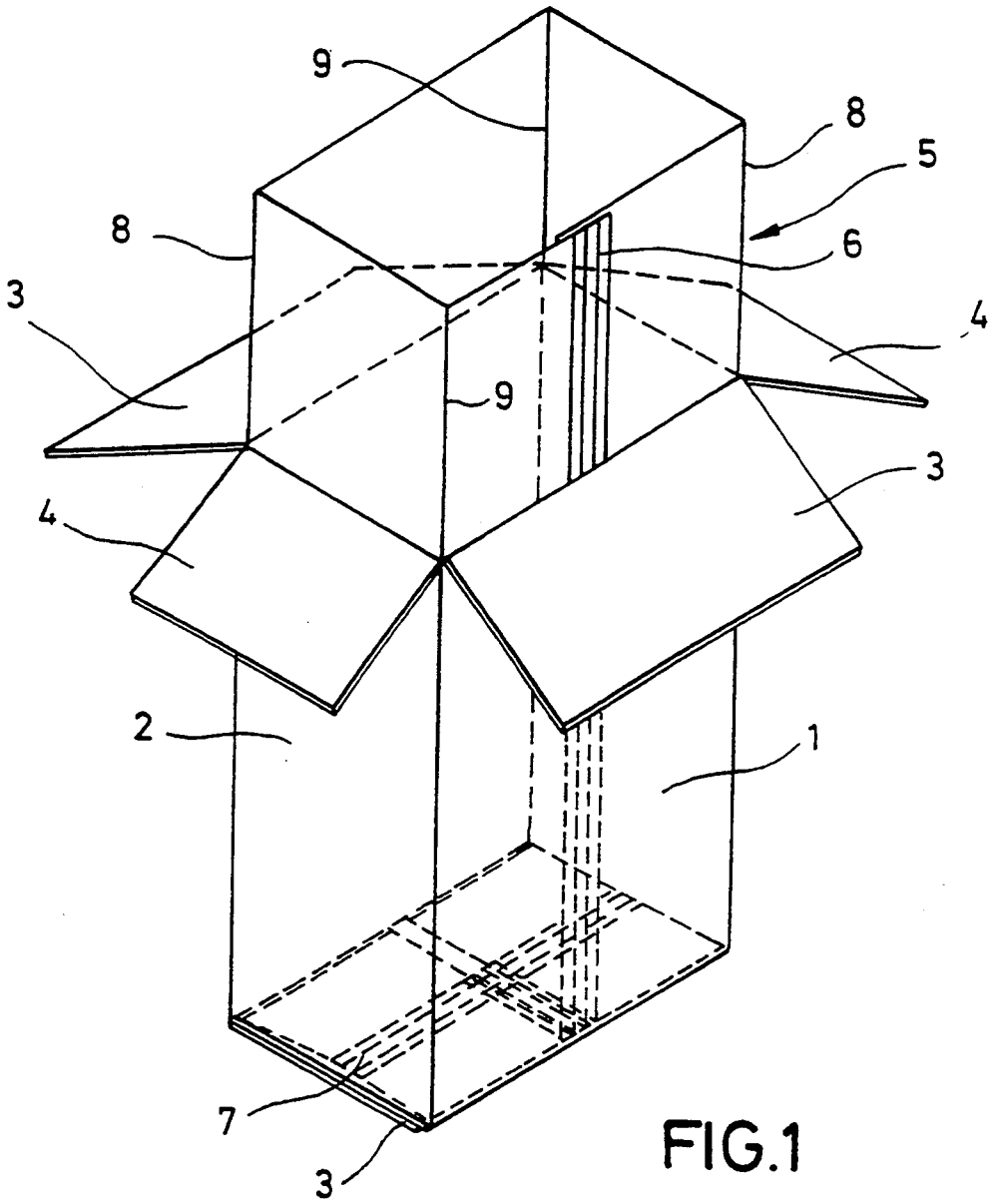
FIG. 1 is a perspective view of a folding box in erected, partially closed condition, ready for filling.

A normal folding box having a body of main surfaces 1 and side surfaces 2 can be seen in FIG. 1, at which upper and lower flaps 3 and 4 are attached.

A tubular foil section 5 is located in the folding box which consists of a foil web and which comprises a welded longitudinal seam 6 which extends in one of the main surfaces of the folding box. This tubular foil section 5 consists of a sealable material, especially of a heat-sealable material, as e.g. thermoplastic material or coated metal sheet or the like, as described before.

In the drawing, the folding box is already closed at its bottom, where also the tubular foil section 5 is already sealed and folded in. The lower sealing seam, which forms the bottom of the inner bag formed of the tubular foil section 5, is given the reference numeral by 7 in FIG. 1.

It can be seen, that the length of the tubular foil section is larger than the length of the body of the folding box, so that it extends up between the flaps 3 and 4 which are shown in FIG. 1, laterally folded to the side, to make the upper end of the inner bag formed by the tubular foil section 5 accessible for sealing (after filling the same).

As can clearly be seen in FIG. 1, the corners of the tubular foil section 5 are very distinctly shown. This is the result of providing the tubular foil section with fold lines in accordance with the invention.

Figure 2:
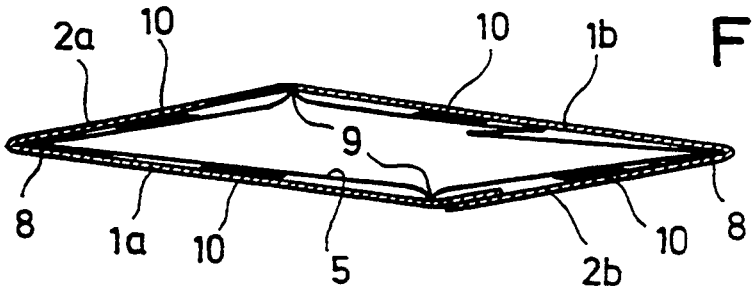
FIG. 2 is a cross section through the body of the folding box according to FIG. 1 in partially erected condition.

As the schematic cross section in FIG. 2 shows, the tubular foil section 5 not only has fold lines 8 where two joining sections of the body form an acute angle in the flat condition of the pre-glued folding box (these sections are characterized by the same suffixes a and b, respectively), but there are also embossed fold lines 9 where two joining main surfaces of the body of the pre-glued flat folding box join each other at acute or straight angle. These sections are characterized with different suffixes a and b in FIG. 2.

At this point it has to be noted, that FIG. 2 is not in correct scale so that the fold lines 9 can be better shown. Thus, the adhesions between the tubular foil section 5 and the inner surfaces of the body are only shown by some broad glueing points 10. In reality the adhesions can extend over the whole surface, so that the fold lines 9 in the body are not distinctly shown. In each case, however, the fold lines 9 can be distinctly seen in the area of the tubular foil section 5, which is located between the flaps 3 and 4 which are not adhered to the tubular foil section.

The folding box shown in FIG. 1 is filled. After filling the flaps 3 and 4 are folded off the inner bag formed by the tubular section 5—if not done before—so that the closing and sealing tools can be guided to the inner bag. The inner bag is then sealed and folded into the folding box. Afterwards the flaps 4 and 3 are folded and glued together, so that the folding box is closed.

What is claimed is:

1. Pre-glued, flat folding box, consisting of a body portion having a cross section when in flat condition which is defined by two acute-angular corners and two obtuse-angular corners and having a rectangular inner cross section when set up in an upright, open condition, said box in said upright, open condition having open sides and flaps connected to said open sides and a tubular foil section having open ends and being arranged in said body portion and having a cross section when in said upright, open condition which corresponds to the inner cross section of the body portion said tubular foil section being glued to the body portion and extending at said open ends at least between the flaps and comprising pre-formed first fold lines which extend in the two acute-angular corners of the inner cross section of the body portion, said fold lines extending continuously up to the open ends of the tubular foil section, said tubular foil section also comprising pre-formed second fold lines which extend in the two obtuse-angular corners of the inner cross section of the body portion, said second fold lines extending continuously up to the open ends of the tubular foil section.

2. Folding box according to claim 1, wherein at least the second fold lines are produced by embossing.

3. Folding box according to claim 2, wherein the fold lines are produced by heat embossing.

4. Folding box according to one of claims 1 to 3, wherein the tubular foil section consists of a flexible material.

5. Folding box according to one of claims 1 to 3, wherein wall sections of the tubular foil section adjacent the second fold lines when the body portion is in flat condition each include an angle of approximately 90°.

6. Folding box according to claim 4, wherein wall sections of the tubular foil section adjacent the second fold lines when the body portion is in flat condition each include an angle of approximately 90°.

7. A method for producing a flat folding box consisting of a body portion having a cross section when in flat lying condition which is defined by two acute-angular corners and two obtuse-angular corners, said body portion in an open, upright condition having a rectangular inner cross section having open sides and flaps connected to said open sides, and a tubular foil section having open ends and being arranged in said body portion and having a cross section when said body portion is in an open, upright condition which corresponds to the inner cross section of said body portion, said tubular foil section being glued to the body portion and extending at both open ends at least between the flaps and comprising pre-formed first fold lines which extend in the two acute-angular corners of the inner cross section of the flat body portion, said fold lines extending continuously up to the open ends of the tubular foil section, said tubular foil section also comprising pre-formed second fold lines which extend in the two obtuse-angular corners of the inner cross section of the body portion, said second fold lines extending continuously up to the open ends of the tubular foil section, the method comprising the steps of providing a flat foil web having two lateral edges, forming four continuous fold lines in said foil web at locations spaced from each other and parallel to said lateral edges, bringing the two lateral edges of the web to match each other and connecting same with one another in sealed condition to form a tubular foil, providing a flat folding box blank having parallel fold lines separating four box blank sections from each other, disposing and gluing a section of said tubular foil on two of said box blank sections with fold lines of the tubular foil section lying on fold lines of the folding box blank, and folding other sections of the folding box blank on the tubular foil section lying on top of said first sections of said box blank and gluing said other box blank sections to said tubular foil section and gluing a glue flap provided at one of said other box blank sections to the other of said other box blank sections.

8. Method according to claim 7, wherein at least the second fold lines in the foil web are produced by embossing.

* * * * *